US011834818B1

(12) United States Patent
Osterneck

(10) Patent No.: US 11,834,818 B1
(45) Date of Patent: Dec. 5, 2023

(54) UNIVERSAL DRAINPIPE INTERFACING WITH OVERFLOW AND NON-OVERFLOW DRAINS

(71) Applicant: Milton Osterneck, Goodyear, AZ (US)

(72) Inventor: Milton Osterneck, Goodyear, AZ (US)

( * ) Notice: Subject to any disclaimer, the term of this patent is extended or adjusted under 35 U.S.C. 154(b) by 0 days.

(21) Appl. No.: 18/308,102

(22) Filed: Apr. 27, 2023

(51) Int. Cl.
*E03C 1/22* (2006.01)

(52) U.S. Cl.
CPC ..... *E03C 1/22* (2013.01)

(58) Field of Classification Search
CPC ..... E03C 1/22
See application file for complete search history.

(56) References Cited

U.S. PATENT DOCUMENTS

| | | | | |
|---|---|---|---|---|
| 4,807,306 | A | 2/1989 | Hayman et al. | |
| 5,444,183 | A * | 8/1995 | Gehrs | H02G 3/085 174/666 |
| 8,201,581 | B2 | 6/2012 | George | |
| 9,115,485 | B2 | 8/2015 | Thommelin et al. | |
| 10,301,803 | B2 | 5/2019 | Beck et al. | |
| D883,450 | S | 5/2020 | Kuo | |
| 10,808,386 | B2 | 10/2020 | Beck | |
| 11,704,992 | B2 * | 7/2023 | Wittrup | G08B 21/245 381/56 |
| 2006/0108558 | A1 | 5/2006 | Wooldridge | |
| 2017/0204592 | A1 | 7/2017 | Chen | |
| 2021/0207351 | A1 | 7/2021 | Ahuja | |
| 2023/0078805 | A1 * | 3/2023 | Sapp | E03C 1/232 4/651 |
| 2023/0111926 | A1 * | 4/2023 | Sapp | E03C 1/232 4/689 |
| 2023/0148123 | A1 * | 5/2023 | Sapp | E03C 1/23 4/287 |

* cited by examiner

*Primary Examiner* — Kevin R Barss
(74) *Attorney, Agent, or Firm* — Albert Bordas, P.A.

(57) ABSTRACT

A universal drainpipe interfacing with overflow and non-overflow drains having a drainpipe, sink, and drain system. The drainpipe has a closed configuration and an overflow configuration. The drainpipe has a side wall. The side wall has two overflow assemblies, each having a preset channel and a punch-out stamp. If a predetermined amount of force were to be applied, the preset channel and punch-out stamp break away to expose overflow openings in which the sink overflow system can interface with. If the drain were to be installed in a sink without a sink overflow system, the preset channels and punch-out stamps, that are integrated part of the side wall, would not be removed, leaving the side wall sealed. This drain would be able to interface with both overflow and non-overflow drains without the need for additional tools or expertise.

18 Claims, 5 Drawing Sheets

UNIVERSAL DRAINPIPE INTERFACING WITH OVERFLOW AND NON-OVERFLOW DRAINS

BACKGROUND OF THE INVENTION

Field of the Invention.

The present invention relates to drainpipes, and more particularly, to drainpipes that interface with overflow and non-overflow sink systems.

Description of the Related Art.

Applicant believes that one of the closest references corresponds to U.S. Pat. No. 10808386 B2, issued on Oct. 20, 2020, to Harold Kent Beck for Sink drainpipe with and without overflow ports. However, it differs from the present invention because Beck teaches a conventional bathroom sink has an overflow port and an overflow conduit. A conventional drain pipe for the conventional sink has overflow ports in fluid communication with the sink's overflow port. A vessel sink does not have an overflow port. A prior art drain pipe that does not have overflow ports has been used with vessel sinks. The present method provides a new drain pipe with overflow ports for a conventional sink and means for covering and sealing the overflow ports in the new drain pipe so that the new drain pipe can also be used with a vessel sink that does not have an overflow port. Means for covering and sealing the overflow ports include an inner sleeve that fits inside the drain pipe, an outer sleeve that surrounds the drain pipe and grommets and hole plugs that that fit inside the overflow ports, where all of the means cover and seal the overflow ports so that the new drain pipe does not leak when used with a vessel sink that does not have an overflow port.

Applicant believes that another reference corresponds to U.S. Patent Publication No. 20210207351 A1 published to Sanjay Ahuja on Jul. 8, 2021 for Kits for reducing inventory of sink drain assemblies. However, it differs from the present invention because Sanjay teaches a method provided for a plumbing parts supplier to reduce inventory of sink drain assemblies. Drain assemblies for overflow-type sinks have an overflow port, while drain assemblies for vessel sinks do not. Some drain assemblies have open and closed positions, while a grid drain or an umbrella drain does not. A drain assembly may be available in different finishes. Rather than having an inventory of drain assemblies for all possible applications, kits are provided that allow an end-user to assemble one of two or more drain assemblies. One kit includes a drain assembly for an overflow-type sink and a sleeve that fits in the drain assembly and covers an overflow port. Other 3 kits include a drain assembly with a push-type open-close mechanism and means for keeping the drain assembly in the open position. Another kit includes a push-button drain assembly with an overflow port, means for converting it an umbrella drain and a sleeve for covering the overflow port.

Applicant believes that another reference corresponds to U.S. Pat. No. 4807306, issued on Feb. 28, 1989 to Hayman et al. for Pop-up drain assembly for lavatory basins. However, it differs from the present invention because Hayman teaches a disclosed improved pop-up drain assemblies for lavatory basins, with unique structure involving the removable inner seat and compression nut receiver portion, the removable inner seat member for the rod bearing part, and the drain conduit portion.

Applicant believes that another reference corresponds to U.S. patent application Publication No. 9115485 B2, issued on Aug. 25, 2015 to Thommelin et al. for a tub including a receptacle suitable for containing water. However, it differs from the present invention because Thommelin teaches a tub that includes a compartment communicating with a discharge orifice of the tub and including an opening emerging in one face of the tub. The tub also includes a communication orifice suitable for the passage of water from the receptacle to the compartment, the compartment housing a water discharge system. A control plate forms a cover in the opening of the compartment and is configured for actuating the opening and closing of the water discharge system, the control plate being flush with the surface of the face of the tub when the discharge system is in the open position.

Applicant believes that another reference corresponds to U.S. Pat. No. 10301803 B2, issued on May 28, 2019 to Beck et al. for a Push-type drain stopper is usable in a drain pipe that has a pivot rod port surrounded by a stub by sealing a rod that protrudes into the pipe through the stub. However, it differs from the present invention because Beck teaches a retrofit kit includes the drain stopper, pivot balls sized to fit different pop-up drain assemblies, a rod that passes through the ball into the drain pipe, and a wing nut fixed to a lower end of the rod for tightening the rod against a stub cap. A stopper is pressed transversely into engagement with the rod, which is an anchor. The drain pipe has a drain flange that seals around a drain opening in a sink. If the flange becomes worn and unsightly or if one desires to change a color scheme for the sink, a cap that has a diameter greater than the drain flange hides the drain flange from sight.

Applicant believes that another reference corresponds to U.S. Pat. No. 20060108558 A1, issued on May 25, 2006 to Wooldridge for outlet arrangement. However, it differs from the present invention because Wooldridge teaches an outlet arrangement (10) for adapting a water receptacle (40*b*) having a smaller diameter outlet for use with a larger diameter waste outlet and trap. The arrangement (10) includes an outlet member (16) and a locking collar (12). The outlet member (16) has a first lower end (20) adapted to seal against an opening (46) of either the Smaller or the larger diameter and a second threaded end (28) adapted to fit through an opening (42) of the Smaller diameter. The locking collar (12) has an internal thread (32) adapted to engage with the second threaded end (28) of the outlet member (16) and an external thread (34) adapted to engage a waste outlet or trap of the larger diameter.

Applicant believes that another reference corresponds to U.S. Pat. No. 8201581 B2, issued on Jun. 19, 2012 to Robert George for Waste water outlet. However, it differs from the present invention because George teaches a waste for an item of sanitary ware generating grey water, the waste comprising: (i) an inlet for admitting grey water; (ii) first and second outlets configured to discharge grey water, the first outlet being arranged to connect to a drainage system, and the second outlet being arranged to connect to a recycling system; (iii) a valve configured to selectively direct water to the first outlet or the second outlet, the valve being located between the inlet and the first and the second outlets, wherein the valve is operable between the first and the second positions, the valve connecting the inlet to the first outlet in the first position and the valve connecting the inlet to the second outlet in the second position; and (iv) a plug dimensioned to fit the inlet and configured to operate the valve by manipulation of the plug.

Applicant believes that another reference corresponds to U.S. Pat. No. 20170204592 A1, issued on Jul. 20, 2017 to Chen for Sink drain device. However, it differs from the present invention because Chen teaches a sink drain device that includes a tubular main body having a tubular surrounding wall that extends along an axis and that defines a drain channel, and a strainer detachably mounted in the tubular main body. The tubular surrounding wall has an internal thread. The strainer has opposite upper and lower surfaces, a side surrounding surface extending downwardly from a periphery of the upper surface, a non-circular operating hole formed in the upper surface and registered with the axis, a plurality of drain holes extending through the upper and lower surfaces and surrounding the operating hole, and an external thread formed on the side surrounding surface, and being threadedly and removably connected to the internal thread.

Applicant believes that another reference corresponds to U.S. Pat. No. US D883450, issued on May 5, 2020 to Kuo for Pipe for a sink drain stopper. However, it differs from the present invention because Kuo teaches an ornamental design for a pipe for a sink drain stopper.

Other patents describing the closest subject matter provide for a number of more or less complicated features that fail to solve the problem in an efficient and economical way. None of these patents suggest the novel features of the present invention.

SUMMARY OF THE INVENTION

The present invention is a universal drainpipe interfacing with overflow and non-overflow drains, comprising a drainpipe and a sink. The drainpipe comprises a side wall. The side wall comprises two integrated overflow assemblies that are part of the side wall. Each overflow assembly has a preset channel and a punch-out stamp that break away to expose an overflow opening. The drainpipe connects the sink to a drain system.

The overflow openings in the side wall are sealed off by punch-out stamps, which are integrated parts of the side wall. Both the openings and the stamps are defined by preset channels. The punch-out stamps and preset channels are sealed parts of the side wall, preventing fluid from exiting the drainpipe.

The punch-out stamps and preset channels are freed from the side wall by applying predetermined forces to the overflow assemblies, resulting in the punch-out stamps and preset channels breaking free from the side wall, exposing the overflow openings.

The overflow assemblies have a closed configuration and an overflow configuration. In the closed configuration, the preset channels and punch-out stamps are intact and integrated parts of the side wall, sealing the side wall. The closed configuration is compatible with a sink without a sink overflow system. In the overflow configuration, the preset channels and the punch-out stamps are broken free and removed from the side wall, exposing the overflow openings. The overflow configuration is compatible with a sink having a sink overflow system.

The drainpipe has a drain opening that interfaces with a variety of drain stoppers, including but not limited to, push and pull drain stoppers, pull drain stoppers, lift and turn drain stoppers, toe touch drain stoppers, flip-it drain stoppers, pop-up drain stoppers, trip lever drain stoppers, stopshroom drain stoppers, and lever type handle drain stoppers. The drainpipe comprises a tailpiece, flange assembly, gasket, convex gasket, and threads.

The tailpiece extends along the lower end of the drainpipe. The tailpiece is utilized to direct fluid flow. The tailpiece is also utilized to provide structural integrity when assembled with a sink.

The flange assembly is attached to the drain opening of the drainpipe. The flange assembly is utilized to funnel fluid into the drainpipe. The flange assembly is also utilized as a structural attachment point for the drainpipe to attach to the sink.

The threads are wrapped helically around the tailpiece to attach the drainpipe to the sink. The gasket interfaces with the flange assembly and a sink opening to create a seal. The convex gasket interfaces with a sink opening and a nut to create a seal. The tailpiece has a sidewall outer diameter of 1-1/4".

Each overflow assembly's center is located approximately 1/4" below the flange assembly. The overflow assembly is approximately 8/25" in height, and 1-1/5" wide with rounded edges.

It is therefore one of the main objects of the present invention to provide a universal drainpipe that can be adjusted to function with a sink with overflow openings or a sink without overflow openings.

It is another object of this invention to provide a universal drainpipe that will reduce the necessary variety of inventory for drainpipes.

It is another object of this invention to provide a universal drainpipe that will reduce the variety of drainpipes manufactures produce.

It is another object of this invention to provide a universal drainpipe that will provide an easy to install drainpipe.

It is another object of this invention to provide a universal drainpipe that is volumetrically efficient for carrying, transporting, and storage.

It is another object of this invention to provide a universal drainpipe, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
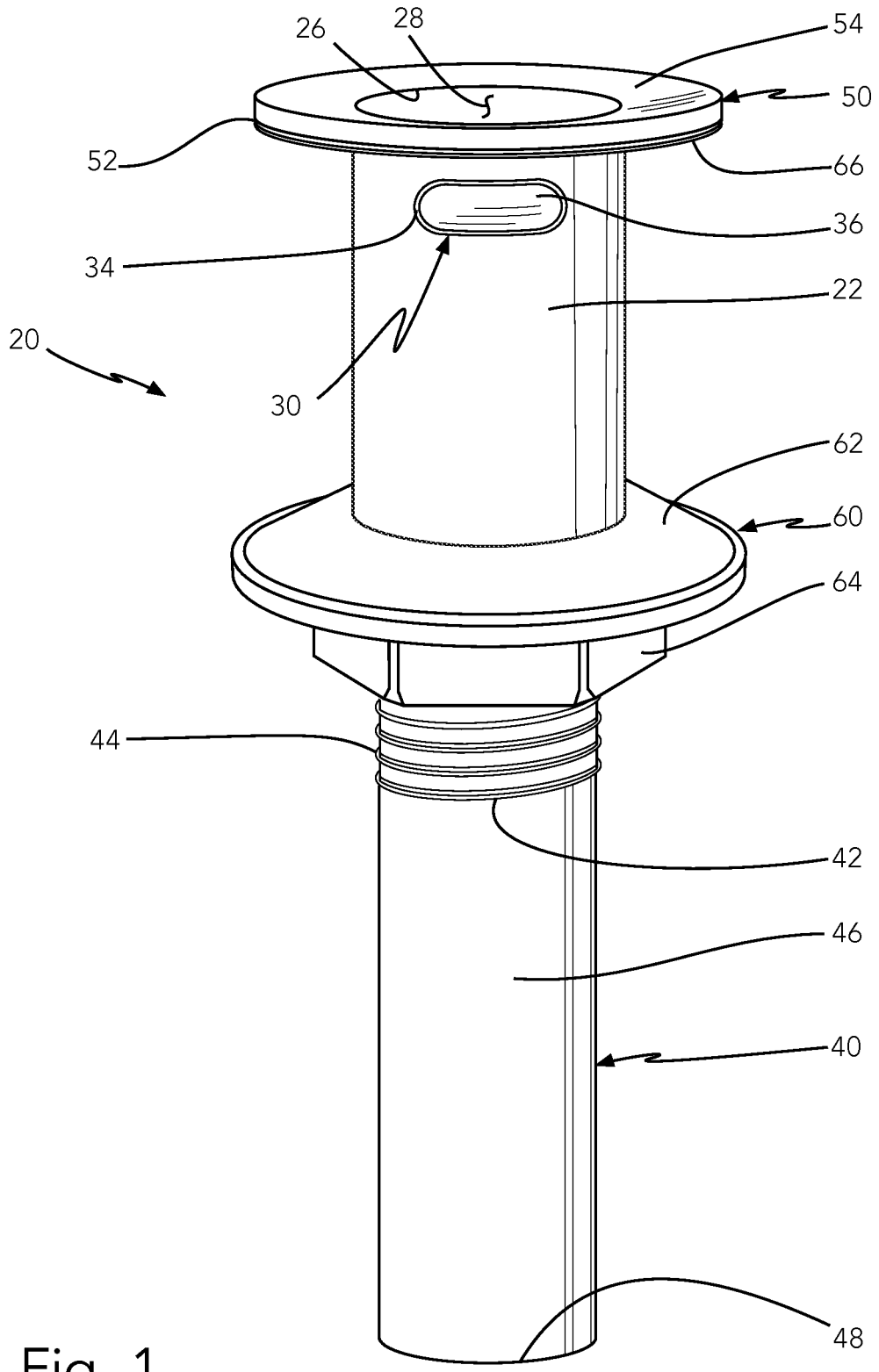
FIG. 1 represents an isometric view of the present invention in a closed configuration with punch-out stamps intact and the present invention in a configuration designed for a non-overflow sink system.

Referring now to the drawings, the present invention is a universal drainpipe interfacing with overflow and non-overflow drains and is referred to with numeral 10. It can be observed that it basically includes drainpipe 20 and sink 80. Drainpipe 20 comprises a closed configuration and an overflow configuration.

Figure 2:
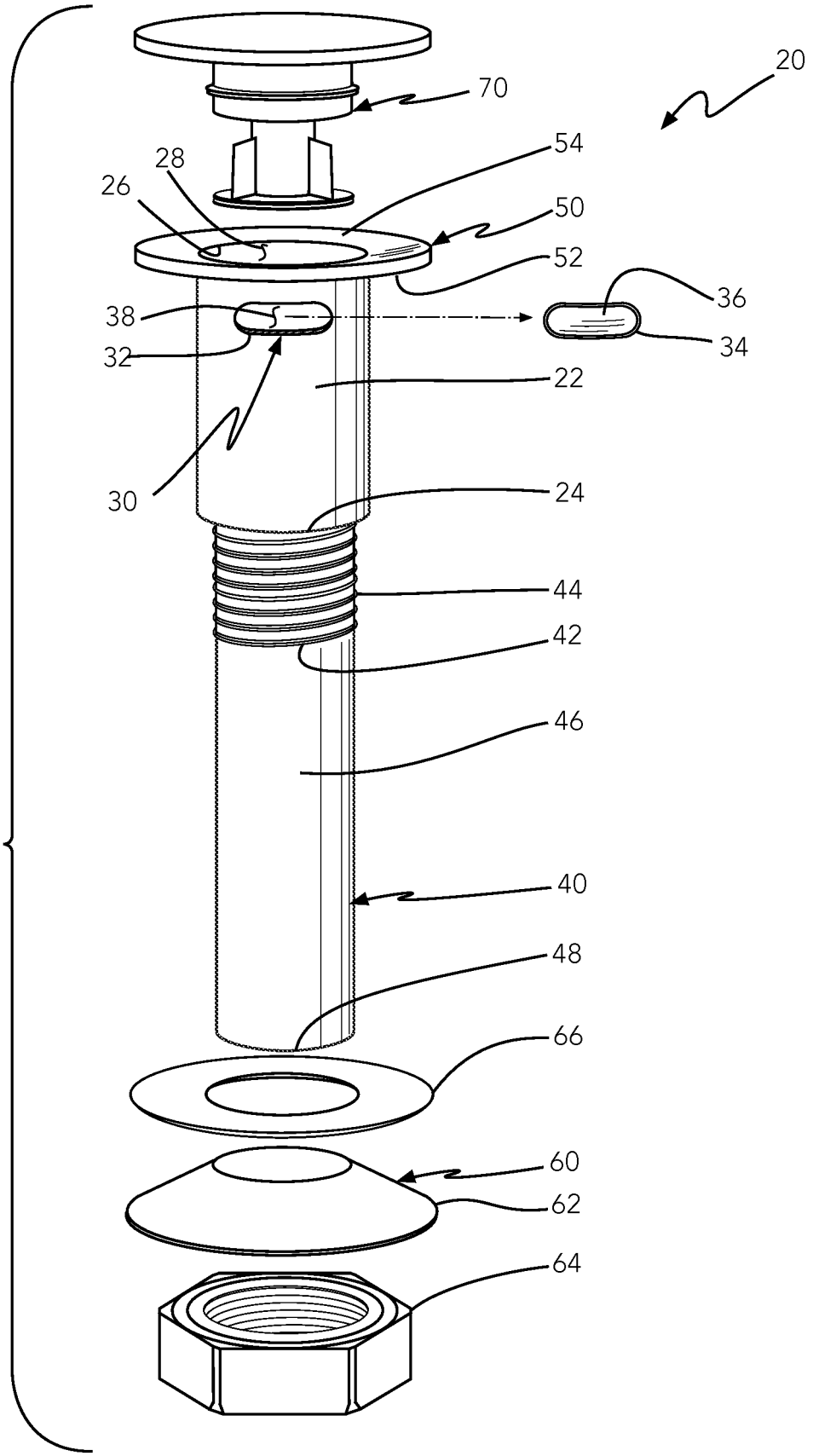
FIG. 2 is an isometric exploded view of the present invention.

As seen in FIGS. 1 and 2, drainpipe 20 comprises tailpiece assembly 40, flange assembly 50, attachment point assembly 60, and two overflow assemblies 30. Only one overflow assembly 30 is pictured, as the second overflow assembly 30 is out of view. Drainpipe 20 comprises drain opening 26 and side wall 22 having two overflow assemblies 30. Tailpiece assembly 40 comprises threaded section end 42, threads 44, tailpiece side wall 46, and tailpiece distal end 48. Flange assembly 50 comprises flange bottom face 52, and flange top face 54. Attachment point assembly 60 comprises convex gasket 62, nut 64, and gasket 66. Tailpiece assembly 40 extends from lower end 24 of drainpipe 20. Tailpiece assembly 40 is utilized to direct fluid flow. Flange assembly 50 is attached to drain opening 26 of drainpipe 20. Flange assembly 50 is utilized to funnel fluid into drain opening cavity 28. Tailpiece side wall 46 has an outer diameter of 1-1/4" intended to interface with drain systems with inner diameter of 1-1/4".

The center of overflow assembly 30 is located approximately 1/4" below flange bottom face 52. Overflow assembly 30 is approximately 8/25" in height, and 1-1/5" wide with rounded edges.

Overflow assemblies 30 have closed configurations and overflow configurations. FIG. 1 represents the closed configuration. In the closed configuration, preset channel 34 and punch-out stamp 36 are intact on side wall 22.

As seen in FIG. 2, the overflow assembly 30 comprises overflow opening 32, preset channel 34, and punch-out stamp 36, which define overflow cavity 38 when removed. Freeing preset channel 34 and punch-out stamp 36 exposes overflow opening 32 and overflow cavity 38. Overflow opening 32 is sealed off by a punch-out stamp 36. Punch-out stamp 36 is an integrated part of side wall 22. Drainpipe 20 has drain opening 26 that interfaces with drain stopper 70. It is noted that present invention 10 may work with a variety of drain stoppers, including but not limited to, push and pull drain stoppers, pull drain stoppers, lift and turn drain stoppers, toe touch drain stoppers, flip-it drain stoppers, pop-up drain stoppers, trip lever drain stoppers, stopshroom drain stoppers, and lever type handle drain stoppers.

Overflow openings 32 are sealed off by punch-out stamps 36. Overflow openings 32 and punch-out stamps 36 are integrated within side wall 22 with preset channels 34. In a preferred embodiment, preset channels 34 have less material than side wall 22, making them a fracture point if stress or a predetermined force were applied to the associated overflow assemblies 30. Punch-out stamps 36 and preset channels 34 are part of side wall 22, sealing side wall 22, which prevents fluid from exiting drainpipe 20 when thereon.

Figure 3:
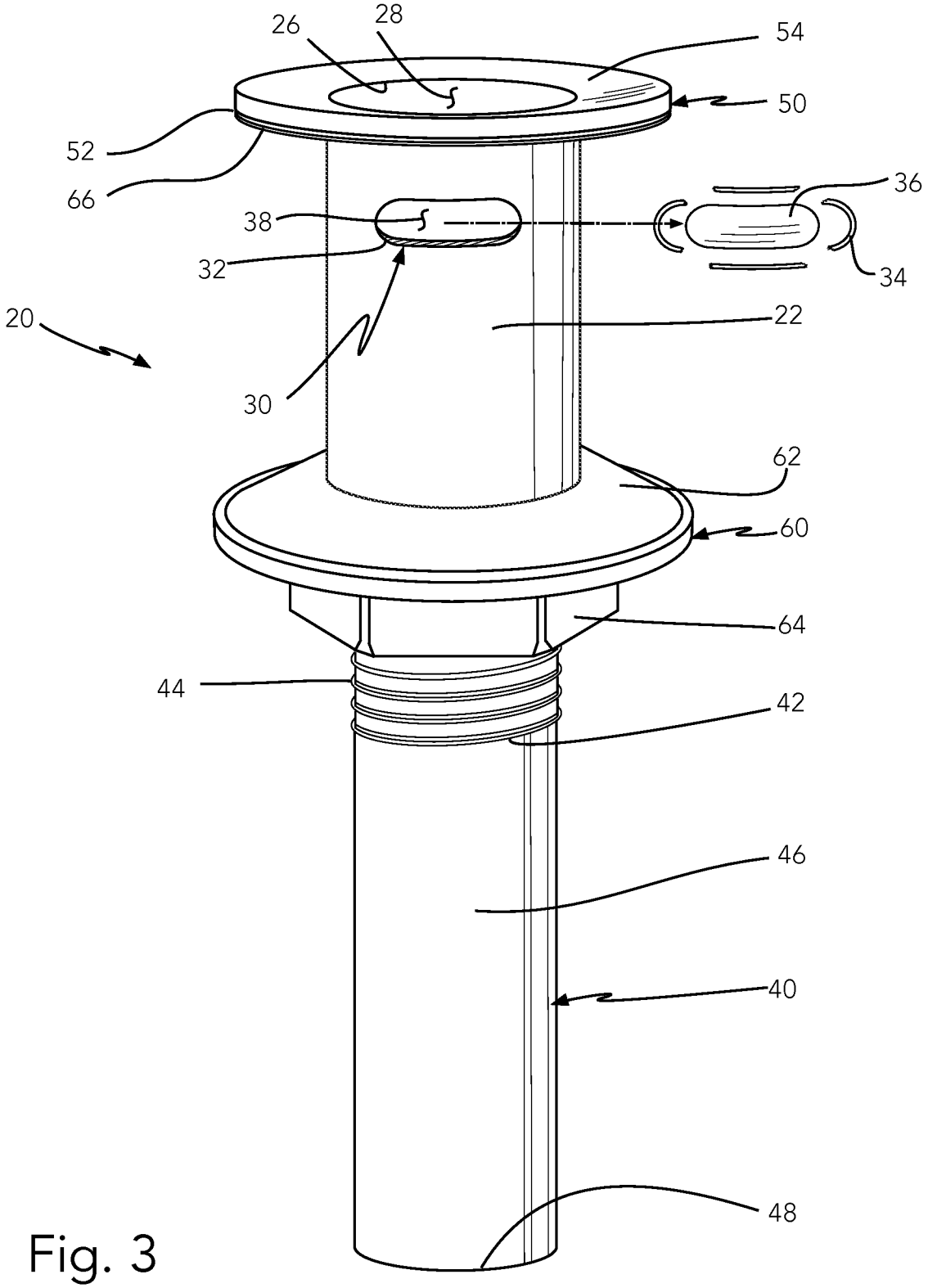
FIG. 3 is an isometric view of the present invention in an overflow configuration with the punch-out stamps removed and the present invention in a configuration designed for an overflow sink system.

As seen in FIG. 3, drainpipe 20 is in the overflow configuration. Punch-out stamps 36 and preset channels 34 are freed from side wall 22 by applying a predetermined force to overflow assemblies 30, resulting in punch-out stamps 36 and preset channels 34 breaking free from side wall 22, exposing overflow openings 32 and overflow cavity 38.

Figure 4:
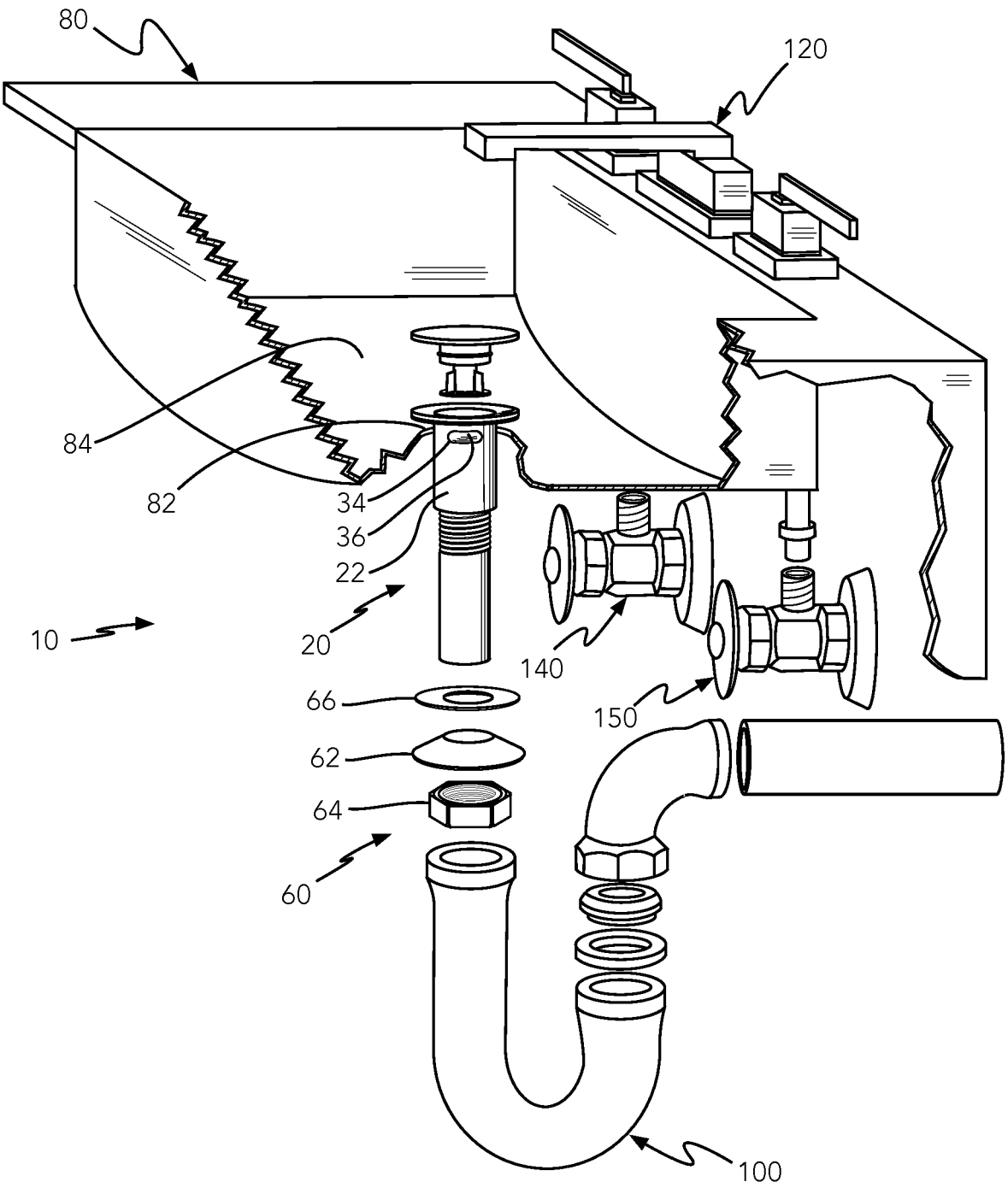
FIG. 4 is an isometric semi-exploded view of the present invention used in conjunction with a non-overflow sink system.

As seen in FIG. 4, sink 80 comprises sink opening 82, sink bowl 84, drain system 100, faucet 120, left shut-off valve 140, and right shut-off valve 150. FIG. 4 represents drainpipe 20 installed in sink 80 without an overflow system. In this closed configuration, preset channels 34 and punch-out stamps 36 are left intact, sealing side wall 22.

Figure 5:
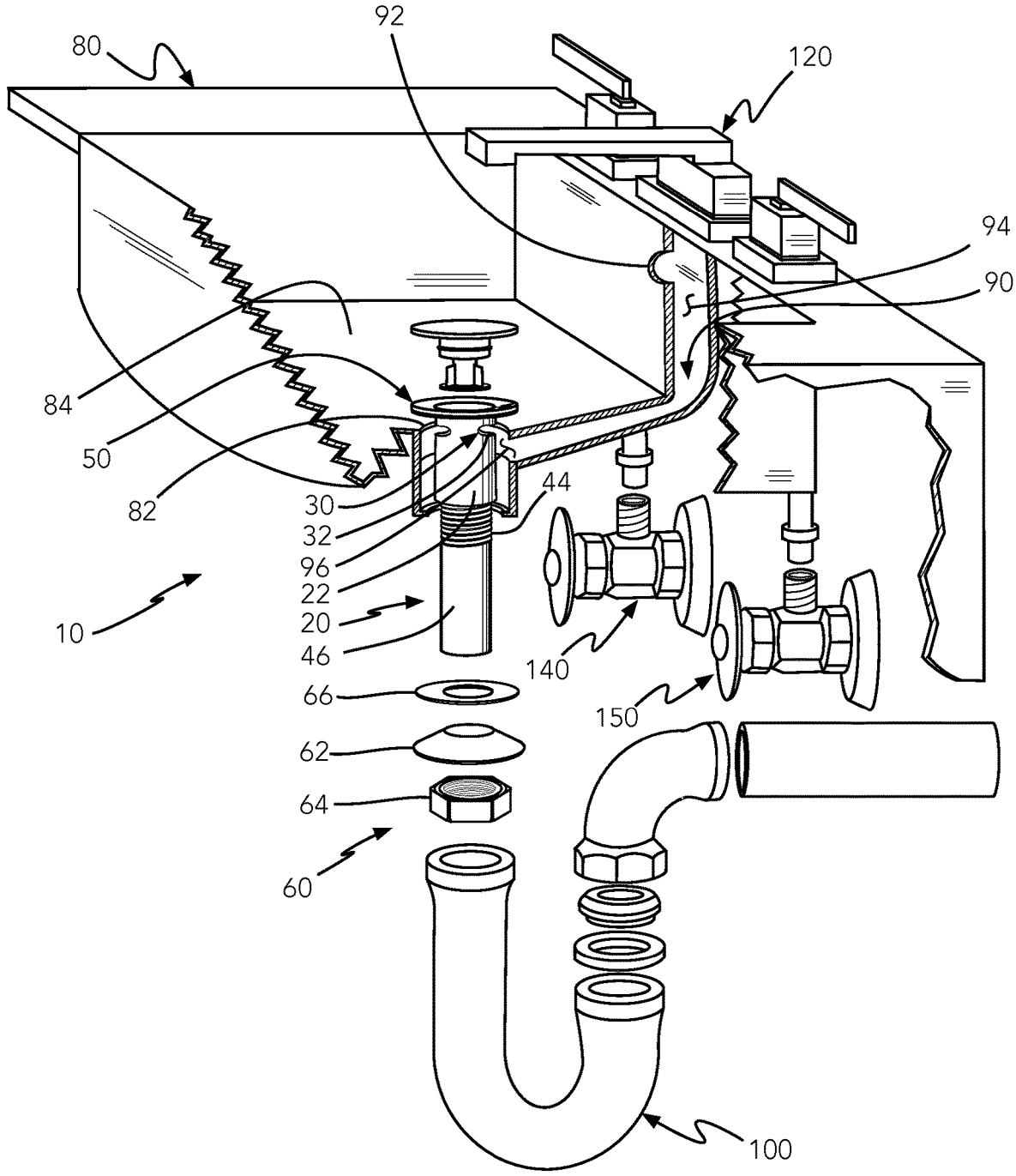
FIG. 5 is an isometric semi-exploded view of the present invention, turned 90°, used in conjunction with a sink having an overflow system.

As seen in FIG. 5, sink 80 has sink overflow system 90, having sink overflow opening 92, and overflow channel cavity 94 that defines sink overflow cavity 96. Drainpipe 20 is installed in an overflow configuration, with preset channels 34 and punch-out stamps 36, seen in FIG. 2, removed from overflow assemblies 30, exposing overflow openings 32 and overflow cavities 38, seen in FIG. 3. When sink opening 82 is blocked and sink bowl 84 fills with fluid, the fluid would flow into sink overflow opening 92. This fluid will flow through overflow channel cavity 94, and fill sink overflow cavity 96. With sink overflow cavity 96 filled, the fluid would drain into overflow openings 32 and properly drain into drainpipe 20.

Threads 44 are wrapped helically around tailpiece side wall 46 to attach drainpipe 22 to sink 80. Gasket 66 interfaces with flange assembly 50 and sink opening 82 to prevent fluid from leaking. Convex gasket 62 interfaces with sink opening 82 and nut 64 to prevent fluid from leaking. Flange assembly 50 is also utilized as a structural attachment point for drainpipe 20 to attach to sink opening 82.

Although not illustrated, it is noted that present invention 10 may work with a multitude of different sink designs and plumbing drain systems. In a preferred embodiment, drainpipe 20 is made of plastic. However, drainpipe 20 may also be made of metal, PVC, or any material having similar characteristics that are preferred for plumbing use.

What is claimed is:

1. A universal drainpipe interfacing with overflow and non-overflow drains, comprising:

A) a drainpipe having a side wall comprising two overflow assemblies, each comprising a respective preset channel and punch-out stamp that break away to expose an overflow opening, said drainpipe comprises a drain opening interfacing with drain stoppers, a tailpiece assembly, a flange assembly, and an attachment point assembly;

B) a sink; and

C) a drain system, wherein said drainpipe connects said sink to said drain system.

2. The universal drainpipe interfacing with overflow and non-overflow drains set forth in claim 1, wherein said overflow openings are sealed off by said punch-out stamps.

3. The universal drainpipe interfacing with overflow and non-overflow drains set forth in claim 1, wherein said overflow openings and said punch-out stamps are connected to said side wall of said drainpipe by said preset channels, whereby said preset channels comprise less material than said sidewall.

4. The universal drainpipe interfacing with overflow and non-overflow drains set forth in claim 1, wherein said overflow openings, said punch-out stamps, and said preset channels are sealed to said side wall, preventing fluid from exiting said drainpipe.

5. The universal drainpipe interfacing with overflow and non-overflow drains set forth in claim 1, wherein said punch-out stamps and said preset channels are freed from said side wall by applying predetermined forces to said overflow assemblies, resulting in said punch-out stamps and said preset channels breaking free from said side wall, exposing said overflow openings.

6. The universal drainpipe interfacing with overflow and non-overflow drains set forth in claim 1, wherein said drainpipe comprises a closed configuration and an overflow configuration.

7. The universal drainpipe interfacing with overflow and non-overflow drains set forth in claim 6, wherein, in said closed configuration, said preset channels and punch-out stamps intact and part of said side wall, sealing said side wall.

8. The universal drainpipe interfacing with overflow and non-overflow drains set forth in claim 6, wherein in said overflow configuration, said preset channels and said punch-out stamps are broken free and removed from said side wall, exposing said overflow openings.

9. The universal drainpipe interfacing with overflow and non-overflow drains set forth in claim 6, wherein said closed configuration is compatible with said sink.

10. The universal drainpipe interfacing with overflow and non-overflow drains set forth in claim 6, wherein said overflow configuration is compatible with a sink having a sink overflow system.

11. The universal drainpipe interfacing with overflow and non-overflow drains set forth in claim 1, wherein said tailpiece assembly extends along a lower end of said drainpipe.

12. The universal drainpipe interfacing with overflow and non-overflow drains set forth in claim 1, wherein said tailpiece assembly directs fluid flow and provides structural integrity when assembled with said sink.

13. The universal drainpipe interfacing with overflow and non-overflow drains set forth in claim 1, wherein said flange assembly is attached to said drain opening of said drainpipe.

14. The universal drainpipe interfacing with overflow and non-overflow drains set forth in claim 1, wherein said flange assembly funnels fluid into said drainpipe and allows said drainpipe to attach to a sink opening.

15. The universal drainpipe interfacing with overflow and non-overflow drains set forth in claim 1, wherein said tailpiece assembly comprises threads, whereby said threads wrap helically around a section of a tailpiece side wall to secure said drainpipe.

16. The universal drainpipe interfacing with overflow and non-overflow drains set forth in claim 15, wherein said tailpiece side wall has an outer diameter of 1-1/4".

17. The universal drainpipe interfacing with overflow and non-overflow drains set forth in claim 14, wherein said attachment point assembly comprises a gasket, whereby said gasket interfaces with said flange assembly and said sink opening to prevent fluid leakage.

18. The universal drainpipe interfacing with overflow and non-overflow drains set forth in claim 14, wherein said attachment point assembly further comprises a convex gasket, said convex gasket interfaces with said sink opening and a nut to prevent fluid leakage.

* * * * *